US008410891B2

(12) United States Patent
Feichtinger et al.

(10) Patent No.: US 8,410,891 B2
(45) Date of Patent: Apr. 2, 2013

(54) ELECTRICAL MULTILAYER COMPONENT

(75) Inventors: Thomas Feichtinger, Graz (AT); Georg Krenn, Graz (AT); Thomas Puerstinger, Graz (AT)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 13/146,490

(22) PCT Filed: Feb. 2, 2010

(86) PCT No.: PCT/EP2010/051247

§ 371 (c)(1), (2), (4) Date: Nov. 15, 2011

(87) PCT Pub. No.: WO2010/089294

PCT Pub. Date: Aug. 12, 2010

(65) Prior Publication Data

US 2012/0044039 A1 Feb. 23, 2012

(30) Foreign Application Priority Data

Feb. 3, 2009 (DE) ..... 10 2009 007 316

(51) Int. Cl.
*H01C 7/10* (2006.01)

(52) U.S. Cl. ..... 338/20; 338/307; 338/309

(58) Field of Classification Search ..... 338/20
See application file for complete search history.

(56) References Cited

U.S. PATENT DOCUMENTS

| | | | | |
|---|---|---|---|---|
| 6,370,010 | B1 * | 4/2002 | Kuroda et al. | 361/306.1 |
| 2006/0170010 | A1 | 8/2006 | Brunner et al. | |
| 2008/0186127 | A1 | 8/2008 | Feichtinger et al. | |
| 2009/0035560 | A1 | 2/2009 | Block et al. | |
| 2010/0014213 | A1 | 1/2010 | Wozniak et al. | |

FOREIGN PATENT DOCUMENTS

| | | | |
|---|---|---|---|
| DE | 10 2004 010 001 | A1 | 9/2005 |
| DE | 10 2004 058 410 | A1 | 6/2006 |
| DE | 10 2005 050 638 | A1 | 6/2007 |
| DE | 10 2007 012 049 | A1 | 9/2008 |
| JP | 11-265808 | A | 9/1999 |
| WO | WO 2007/076849 | A1 | 7/2007 |

* cited by examiner

*Primary Examiner* — Kyung Lee
(74) *Attorney, Agent, or Firm* — Slater & Matsil, L.L.P.

(57) ABSTRACT

The electrical multilayer component includes a base body with external electrodes and internal electrodes. A ceramic varistor layer is provided with the first internal electrode, and a dielectric layer adjoins the varistor layer. The dielectric layer has at least one opening filled with a semiconducting material or a metal.

19 Claims, 5 Drawing Sheets

ELECTRICAL MULTILAYER COMPONENT

This patent application is a national phase filing under section 371 of PCT/EP2010/051247, filed Feb. 2, 2010, which claims the priority of German patent application 10 2009 007 316.7, filed Feb. 3, 2009, each of which is incorporated herein by reference in its entirety.

BACKGROUND

German patent document DE 10 2004 058 410 A1 discloses an electrical multilayer component with an ESD protection element.

SUMMARY OF THE INVENTION

In one aspect, the present invention specifies an electrical multilayer component comprising an ESD protection component having a low breakdown voltage and a low ESD clamping voltage.

An electrical multilayer component is specified, comprising a base body with at least two external electrodes. The electrical multilayer component comprises at least one first and at least one second internal electrode, which are electrically conductively connected to a respective external electrode. The internal electrode is connected to the external electrode directly or via plated-through holes in the multilayer component.

The electrical multilayer component comprises at least one ceramic varistor layer. The ceramic varistor layer comprises at least the first internal electrode. The first internal electrode is preferably enclosed for the most part by the ceramic varistor layer, wherein the first internal electrode can be freely contact-connected at least in the region of the contact with the external electrode thereof. In a further embodiment, the first internal electrode is applied directly on the varistor layer.

The electrical multilayer component comprises at least one dielectric layer. The dielectric layer is arranged at least between a varistor layer and at least one further layer.

Preferably, the further layer comprises the second internal electrode. In one embodiment, the second internal electrode is enclosed for the most part by the further layer, wherein the second internal electrode can be freely contact-connected at least in the region of the contact with the external electrode thereof. In a further embodiment, the second internal electrode is preferably applied directly on the further layer.

The dielectric layer has at least one opening. The opening can be embodied as a perforation, as a cutout or as a cavity. The opening in the dielectric layer is preferably filled with a semiconducting material or a metal. Preferably, the opening is completely filled. In a further embodiment, however, individual or a plurality of closed or open cavities are also present in the filling of the opening.

In one embodiment, the semiconducting material with which one or more openings in the dielectric layer are filled comprises a varistor ceramic. The varistor ceramic with which the opening in the dielectric layer is filled is preferably identical to the varistor ceramic of the further varistor layer.

In a further embodiment, the varistor ceramic in the opening in the dielectric layer is different than the ceramic of the varistor layer.

In a further embodiment, the semiconducting material comprises a resistance material.

In one embodiment, the metal with which one or more openings in a dielectric layer are filled comprises a metal preferably comprising silver, palladium, platinum, silver-palladium or further suitable metals.

In one embodiment, openings in the dielectric layer can be filled with different materials. Preferably, all the openings in a dielectric layer are filled with the same material.

In one embodiment, the base body of the electrical multilayer component comprises covering assemblies that terminate the base body of the multilayer component toward the top and bottom in the thickness direction. The covering assemblies each comprise at least one dielectric layer.

In one embodiment, the covering assemblies of the electrical multilayer component and the dielectric layers which have at least one opening can comprise the same material. In a further embodiment, it is also possible for the covering assemblies and the dielectric layer to comprise different materials.

Preferably, a zirconium oxide ($ZrO_2$) or a zirconium oxide-glass composite, an aluminum oxide ($AlO_x$) or an aluminum oxide-glass composite, a manganese oxide (MnO) or a manganese oxide glass is used for the dielectric layer. However, the dielectric layers can also comprise further suitable materials.

In one embodiment, the electrical multilayer component comprises an individual or a plurality of plated-through holes, so-called vias, by means of which individual or all internal electrodes of the electrical multilayer component are connected to the external contacts.

In one embodiment, the external contacts of the electrical multilayer component are embodied as an array (row or matrix arrangement). In this case, especially a land grid array (LGA) or a ball grid array (BGA) is suitable.

In the case where contact is made with the electrical multilayer component by means of arrays (LGA, BGA), the internal electrodes of the electrical multilayer component are preferably connected to the external contacts via plated-through holes.

In one embodiment of the electrical multilayer component, the dielectric layer comprising at least one opening is embodied in such a way that together with at least two adjacent varistor layers and two overlapping internal electrodes it forms an ESD discharge section.

In a further embodiment, the opening in the dielectric layer is filled with a semiconducting material or a metal, in particular by means of a method of printing the dielectric layer, in such a way that a so-called catch pad, which is known, is formed. A plated-through hole (via) can be arranged thereon, whereby a self-supporting electrode structure is formed above the dielectric layer.

In one preferred embodiment, the electrical multilayer component has the function of a varistor with an integrated ESD protection component.

The varistor preferably has a capacitance of less than 1 pF.

The ESD protection component of the electrical multilayer component is preferably embodied in such a way that it has an ESD breakdown voltage of less than 20 V for a current of 1 mA.

In the case of an ESD pulse having a voltage of 8 kV that is applied to the electrical multilayer component, the ESD protection component of the electrical multilayer component preferably has an ESD clamping voltage of less than 500 V.

An electrical multilayer component as described above has a reduction of the total capacitance of the component specifically by virtue of the arrangement of the small capacitance of the dielectric layer connected in series with the varistor capacitance. The clamping voltage of the electrical multilayer component is only slightly increased by the dielectric layer compared with conventional multilayer components.

The specified clamping voltage of the ESD protection component is substantially dependent on the distance between the internal electrode layers.

Consequently, with a very small capacitance, a low clamping voltage is achieved by means of a design of the electrical multilayer component as described above.

The additional dielectric layer between the varistor layer significantly reduces the total capacitance of the electrical multilayer component, as a result of which the current-carrying capacity and pulse strength of the component are increased further.

BRIEF DESCRIPTION OF THE DRAWINGS

The subjects described above will be explained in greater detail with reference to the following figures and exemplary embodiments. The drawings described below should not be regarded as true to scale. Rather, the illustrations may be illustrated in enlarged, reduced or distorted fashion in specific details. Elements which are identical to one another or which perform the same function are designated by the same reference symbols.

DETAILED DESCRIPTION OF ILLUSTRATIVE EMBODIMENTS

Figure 1:
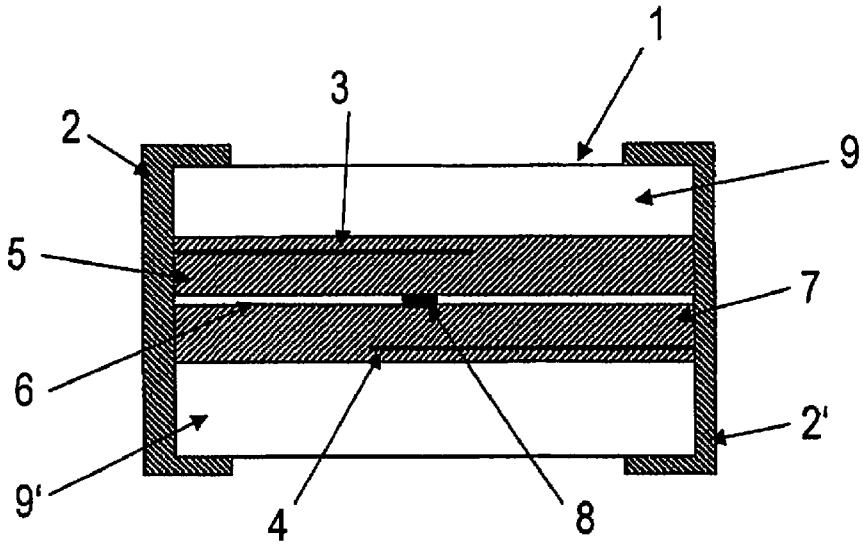
FIG. 1 shows a schematic construction of a first exemplary embodiment of the electrical multilayer component.

FIG. 1 shows a first embodiment of an electrical multilayer component, which comprises a base body 1. External electrodes 2, 2' are arranged at the side areas of the base body 1. The external electrodes are conductively connected to the internal electrodes 3, 4 lying in the interior of the base body 1. The base body 1 has a varistor layer 5 comprising a first internal electrode 3. The first internal electrode 3 is enclosed for the most part by the varistor layer 5. The electrical multilayer component comprises a further layer 7, which is embodied as a further varistor layer in the embodiment illustrated. The further layer 7 comprises a second internal electrode 4, which is enclosed for the most part by the further layer 7.

A dielectric layer 6 having an opening 8 is arranged between the varistor layer 5 and the further layer 7. The opening 8 is filled with a semiconducting material or a metal. The base body 1 of the electrical multilayer component is terminated by covering assemblies 9, 9' in the thickness direction, wherein the covering assemblies 9, 9' preferably each comprise at least one dielectric layer.

Figure 2:
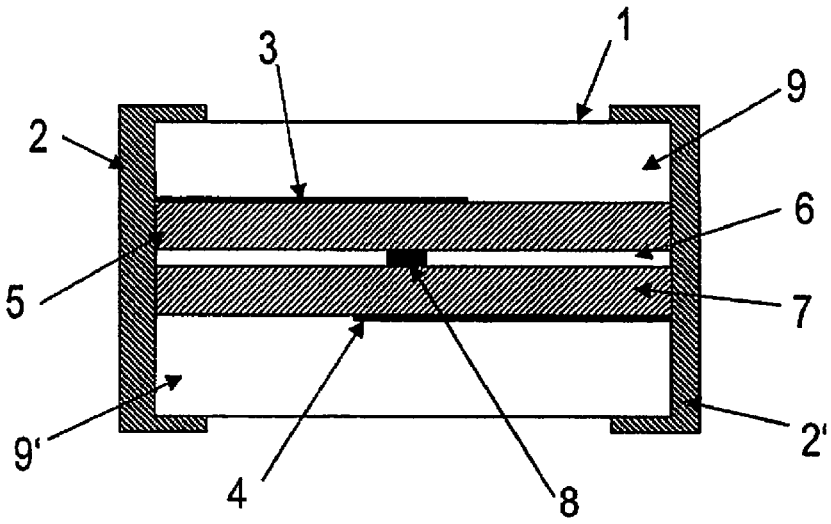
FIG. 2 shows a further embodiment of the electrical multilayer component.

FIG. 2 shows a further embodiment of the electrical multilayer component. The construction of the electrical multilayer component is virtually identical to the construction in FIG. 1, wherein the first internal electrode 3 is applied on a surface of the varistor layer 5 and the second internal electrode 4 is applied on a surface of the further layer 7. The first internal electrode 3 is arranged between the varistor layer 5 and the covering assembly 9. The second internal electrode 4 is arranged between the further layer 7 and the further second covering assembly 9'.

Figure 3:
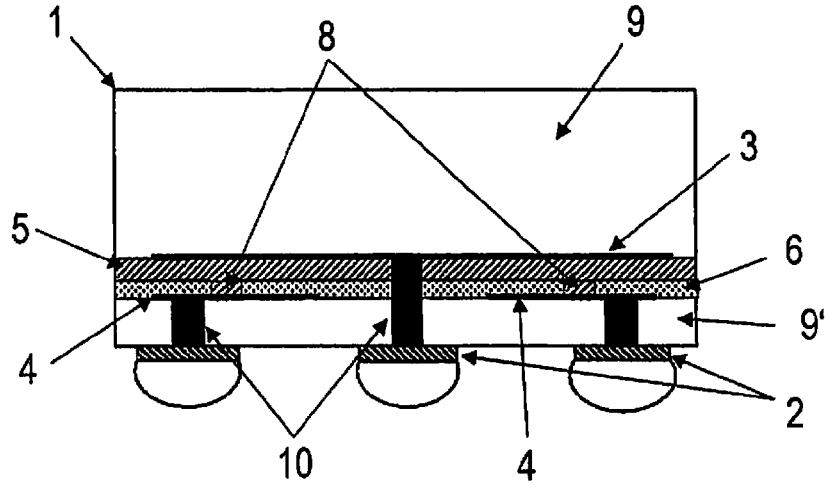
FIG. 3 shows a further embodiment of the electrical multilayer component, wherein the external contacts are embodied as a ball grid array.

FIG. 3 shows a further embodiment of the electrical multilayer component. The electrical multilayer component comprises a base body 1, in which a varistor layer 5 is arranged, on which a first internal electrode 3 is arranged. In the thickness direction, the first internal electrode 3 and the varistor layer 5 are terminated toward the top by a first covering assembly 9. A dielectric layer 6 having openings 8 is arranged below the varistor layer 5. The openings 8 are filled with a semiconducting material or metal. Second internal electrodes 4 are arranged on the underside of the dielectric layer 6. The first internal electrode 3 and the second internal electrodes 4 are connected to external contacts 2 by means of vias 10. The vias 10 can be cylindrical, for example, as illustrated in FIG. 3, or else shaped as truncated cones, wherein the vias 10 can taper, for example, in the direction toward the external contacts 2 or in the direction toward the internal electrodes 3, 4. In the embodiment illustrated, the external contacts 2 are embodied as ball grid arrays. The base body 1 of the electrical multilayer component is terminated by a second covering assembly 9' toward the bottom in the thickness direction.

Figure 4:
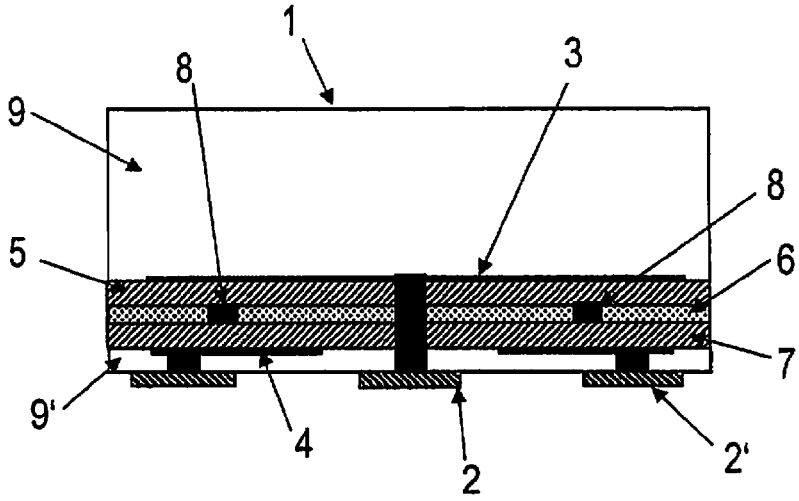
FIG. 4 shows a further embodiment of the electrical multilayer component, wherein the external contacts are embodied as land grid arrays.

FIG. 4 illustrates a further embodiment of the electrical multilayer component, this embodiment being similar to the embodiment in FIG. 3, wherein the dielectric layer 6 has the two openings 8. The dielectric layer 6 is arranged between two layers 5, 7 in the thickness direction. In the embodiment illustrated, the two layers 5, 7 are embodied as varistor ceramic. In the embodiment illustrated, the external contacts 2, 2' of the electrical multilayer component are embodied as land grid arrays. The vias can be cylindrical, for example, as illustrated in FIG. 4, or else shaped as truncated cones, wherein the vias can taper for example in the direction toward the external contacts 2, 2' or in the direction toward the internal electrodes 3, 4.

Figure 5:
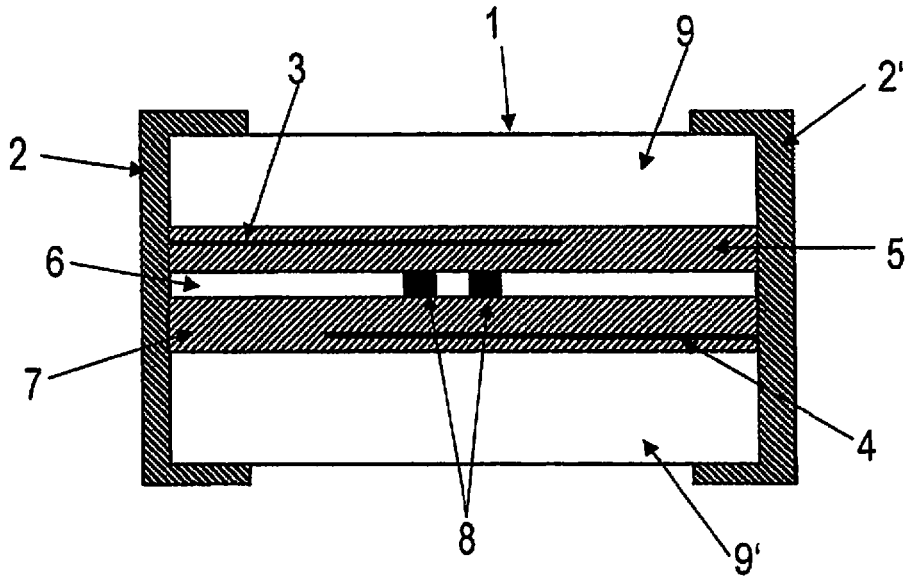
FIG. 5 shows a further embodiment of the electrical multilayer component, wherein the dielectric layer has two openings.

FIG. 5 shows a further embodiment of the electrical multilayer component, this embodiment being similar to the embodiment in FIG. 1. The dielectric layer 6 in FIG. 5 has two openings 8 filled with a semiconducting material or with a metal.

Figure 6:
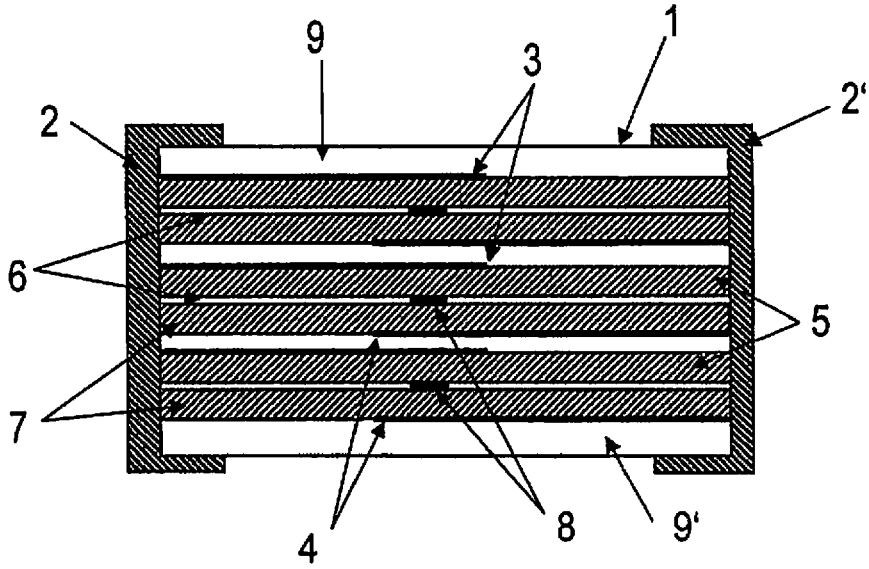
FIG. 6 shows a further embodiment of the electrical multilayer component, which exhibits a plurality of parallel-connected ESD regions in a multilayer component.

FIG. 6 shows a further embodiment of the electrical multilayer component, wherein the electrical multilayer component comprises three ESD protection elements connected in parallel. The ESD protection elements have each already been described in detail per se in FIG. 2. Each of the ESD protection elements comprises a first varistor layer 5 and also a further layer 7. In the embodiment illustrated, the further layer 7 is embodied as a further varistor layer. A dielectric layer 6 having an opening 8 is arranged between the varistor layer 5 and the further layer 7. The opening 8 is filled with a semiconducting material or with metal. The ESD protection elements each have a first internal electrode 3 and a second internal electrode 4, wherein the internal electrodes 3, 4 are applied on the varistor layer 5 and on the further layer 7, respectively.

Figure 7:
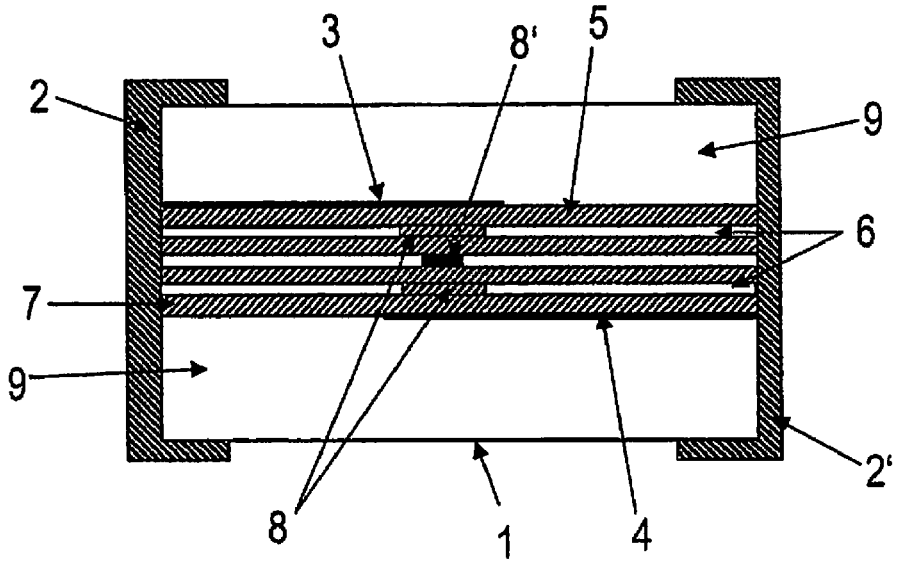
FIG. 7 shows a further embodiment of the electrical multilayer component, wherein a plurality of dielectric layers having perforations are arranged between two electrodes.

FIG. 7 shows a further embodiment of the electrical multilayer component. The electrical multilayer component comprises a base body 1 having covering assemblies 9, 9', wherein the covering assemblies 9, 9' preferably comprise at least one dielectric layer. A varistor layer 5 and a further layer 7 are arranged between the covering assemblies 9, 9', wherein the further layer 7 is embodied as a varistor layer. Arranged between the varistor layer 5 and the further layer 7 are three dielectric intermediate layers 6, which are spaced apart from one another in the thickness direction by intermediate layers composed of a varistor ceramic. The dielectric layers 6 each have an opening 8. The openings 8 in the dielectric layers 6 are each filled with a semiconducting material, and the opening 8' is filled with a metal. The electrical multilayer component comprises internal electrodes 3, 4, which are connected to external contacts 2, 2'. The first internal electrode 3 is arranged between the varistor layer 5 and the covering assembly 9. The second internal electrode 4 is arranged between the further layer 7 and the second covering assembly 9'.

Figure 8:
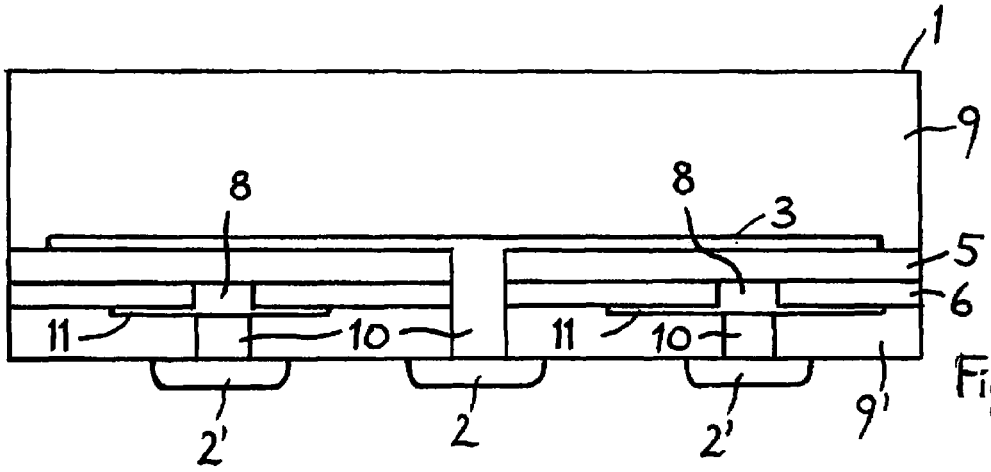
FIG. 8 shows a further embodiment of the electrical multilayer component, wherein, on that side of the dielectric layer which is remote from the varistor layer, a catch pad is present on the filling of the opening.

FIG. 8 shows an embodiment wherein, in a manner similar to the exemplary embodiments in FIGS. 3 and 4, a base body 1, a varistor layer 5, a first internal electrode 3, a first covering assembly 9, a dielectric layer 6 having openings 8, a second covering assembly 9', vias 10 and external contacts 2, 2' are present. The openings 8 are filled with a semiconducting material or metal, such that catch pads 11 are formed, which spread out on a surface of the dielectric layer 6 laterally with respect to the openings 8. In the embodiment in FIG. 8, the catch pads 11 are situated on that side of the dielectric layer 6 which is remote from the varistor layer 5. The catch pads 11 can be produced, for example, by the openings being filled with the semiconducting material or metal by a printing method, such that a proportion of the material used for the fillings forms the catch pads 11 on the top side. The catch pads 11, as illustrated in FIG. 8, can be provided with the associated vias 10 and thus be electrically conductively connected to the external contacts 2'. In this case, the catch pads 11 can function as second internal electrodes. Instead, it is additionally possible to provide second internal electrodes electrically conductively connected to the catch pads 11.

In the embodiment in FIG. 8, typical dimensions are, for example, a thickness of the dielectric layer 6 of 10 μm to 30 μm, a diameter of the openings 8 of 20 μm to 30 μm, a diameter of the catch pads 11 of approximately 100 μm, a thickness of the catch pads 11 of 3 μm to 5 μm, and a height of a via 10 plus catch pad 11 of approximately 50 μm. The vias 10 can be cylindrical or conical, for example.

Figure 9:
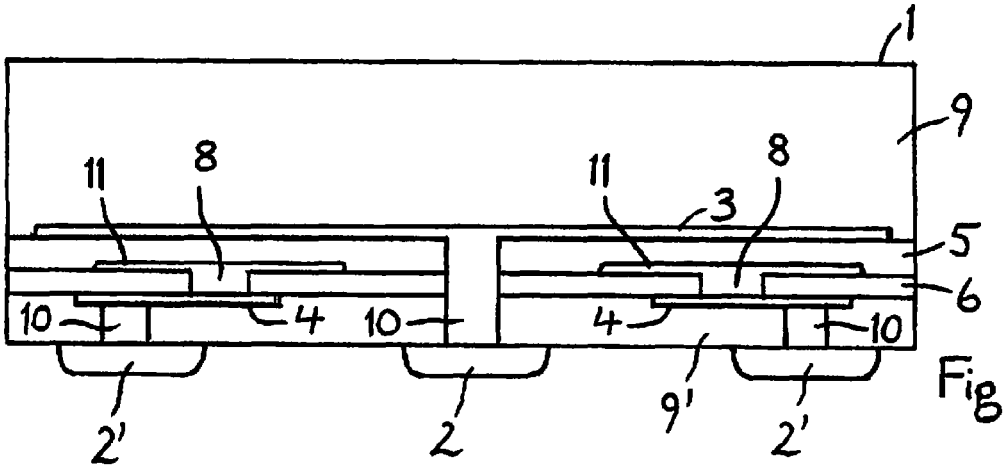
FIG. 9 shows a further embodiment of the electrical multilayer component, wherein, on that side of the dielectric layer which faces the varistor layer, a catch pad is present on the filling of the opening.

FIG. 9 shows a further embodiment, wherein, in a manner similar to the embodiment in accordance with FIG. 8, a base body 1, a varistor layer 5, a first internal electrode 3, a first covering assembly 9, a dielectric layer 6 having openings 8, a second covering assembly 9', vias 10 and external contacts 2, 2' are present. The openings 8 are filled with a semiconducting material or metal, such that catch pads 11 are formed, which spread out on a surface of the dielectric layer 6 laterally with respect to the openings 8. In the embodiment in FIG. 9, the catch pads 11 are situated on that side of the dielectric layer 6 which faces the varistor layer 5. Second internal electrodes 4 are arranged on that side of the dielectric layer 6 which is remote from the varistor layer 5 and are electrically conductively connected to external contacts 2' by means of vias 10. The dimensions, in particular of the openings 8 and of the catch pads 11, can correspond to the dimensions specified above with regard to the embodiment in FIG. 8.

In further embodiments, the electrical multilayer component comprises a plurality of ESD protection devices which are connected in series or in parallel and which are formed by at least one dielectric layer having one or more openings and at least one adjoining varistor layer.

It lies within the scope of the invention to combine features of the described embodiments with one another in order to obtain further embodiments.

List of Reference Symbols

1 Base body
2, 2' External electrode
3 First internal electrode
4 Second internal electrode
5 Varistor layer
6 Dielectric layer
7 Further layer
8, 8' Opening
9, 9' Covering assembly
10 Vias
11 Catch pad

The invention claimed is:

1. An electrical multilayer component comprising:

a base body with external electrodes;

internal electrodes, each internal electrode electrically conductively connected to one of the external electrodes;

a ceramic varistor layer provided with one of the internal electrodes; and a dielectric layer adjoining the varistor layer, wherein the internal electrodes are arranged on mutually opposite sides of the dielectric layer, and wherein the dielectric layer has an opening between the internal electrodes, the opening filled with a semiconducting material or a metal, such that the semiconducting material or the metal present in the opening adjoins the dielectric layer in which the opening is formed and also the varistor layer but is not directly electrically connected to the electrodes.

2. The electrical multilayer component according to claim 1, wherein the opening is filled with the semiconducting material comprising a varistor ceramic or a resistance material.

3. The electrical multilayer component according to claim 1, wherein the opening is filled with metal comprising Ag, Pd, Pt or AgPd.

4. The electrical multilayer component according to claim 1, further comprising a further layer arranged on that side of the dielectric layer that is remote from the varistor layer, the further layer being embodied as a ceramic varistor layer and being provided with one of the internal electrodes.

5. The electrical multilayer component according to claim 1, wherein the dielectric layer comprises $ZrO_2$, a $ZrO_2$-glass composite, $AlO_x$, an $AlO_x$ glass, MgO or an MgO glass.

6. The electrical multilayer component according to claim 1, wherein the base body has covering assemblies, each covering assembly comprising at least one further dielectric layer.

7. The electrical multilayer component according to claim 1, wherein the internal electrodes are connected to the external electrodes by vias.

8. The electrical multilayer component according to claim 1, wherein the external electrodes are embodied as a land grid array or as a ball grid array.

9. The electrical multilayer component according to claim 1, wherein the dielectric layer, together with at least two adjacent varistor layers and two overlapping internal electrodes, form an ESD discharge section.

10. The electrical multilayer component according to claim 1, wherein the component has a function of a varistor with an integrated ESD protection component.

11. The electrical multilayer component according to claim 1, wherein the component has a capacitance of less than 1 pF.

12. The electrical multilayer component according to claim 1, wherein the component has an ESD breakdown voltage of less than 20 V for a current of 1 mA.

13. The electrical multilayer component according to claim 1, wherein the component has an ESD clamping voltage of less than 500 V in the case of an ESD pulse having a voltage of 8 kV.

14. The electrical multilayer component according to claim 1, wherein the opening in the dielectric layer is filled with the semiconducting material or the metal in such a way that a pad is formed.

15. The electrical multilayer component according to claim 14, wherein the pad is provided with a via.

16. The electrical multilayer component according to claim 1, wherein the opening is filled with a semiconducting material.

17. The electrical multilayer component according to claim 1, wherein the opening is filled with a metal.

18. The electrical multilayer component according to claim 14, wherein the pad is spread out on a surface of the dielectric layer laterally with respect to the opening.

19. The electrical multilayer component according to claim 1, wherein the dielectric layer also has a plurality of openings filled with the semiconducting material or the metal, such that the semiconducting material or the metal present in the openings adjoins the varistor layer.

* * * * *